United States Patent [19]

Weber et al.

[11] 4,389,279

[45] Jun. 21, 1983

[54] METHOD OF ETCHING APERTURES INTO A CONTINUOUS MOVING METALLIC STRIP

[75] Inventors: Donald M. Weber; Raymond A. Alleman, both of Lancaster, Pa.

[73] Assignee: RCA Corporation, New York, N.Y.

[21] Appl. No.: 391,418

[22] Filed: Jun. 23, 1982

[51] Int. Cl.[3] ..... C23F 1/02; B44F 1/22; C03C 15/00; C03C 25/06

[52] U.S. Cl. ..... 156/640; 156/644; 156/651; 156/656; 156/661.1; 156/345

[58] Field of Search ..... 156/640, 644, 651, 656, 156/659.1, 661.1, 345; 430/23, 323, 329

[56] References Cited

U.S. PATENT DOCUMENTS

| | | | |
|---|---|---|---|
| 2,750,524 | 6/1956 | Braham | 313/86 |
| 3,679,500 | 7/1972 | Kubo et al. | 156/11 |
| 3,891,491 | 6/1975 | Lerner | 156/640 X |
| 3,929,551 | 12/1975 | Frantzen | 156/345 |
| 3,971,682 | 7/1976 | Frantzen et al. | 156/11 |
| 4,011,123 | 3/1977 | Buysman | 156/345 |
| 4,013,498 | 3/1977 | Frantzen et al. | 156/345 |
| 4,124,437 | 11/1978 | Bond et al. | 156/640 |

*Primary Examiner*—William A. Powell

*Attorney, Agent, or Firm*—E. M. Whitacre; D. H. Irlbeck; L. Greenspan

[57] ABSTRACT

A method of etching a continuous etchable metallic strip from both major surfaces to produce a multiplicity of apertures therethrough, said strip having, on both major surfaces, acid-resistant stencils with openings therein that are registered with one another. The method comprises moving the strip through an etching chamber, spraying liquid etchant toward both of said major surfaces and shielding one of the major surfaces from sprayed liquid etchant during the initial portion of the spraying step. Shielding is achieved by interposing a stationary wall opposite to and spaced from the shielded surface and providing continuous side seals between the wall and the edge portions of the strip.

10 Claims, 8 Drawing Figures

METHOD OF ETCHING APERTURES INTO A CONTINUOUS MOVING METALLIC STRIP

BACKGROUND OF THE INVENTION

This invention relates to a novel method of etching precisely-sized apertures into a continuous moving strip of metal, wherein the widths of the apertures may be smaller than the thickness of the strip. The etched product may be used to make shadow masks for color television picture tubes, as well as other precision-etched products.

A common type of color television picture tube comprises an evacuated glass envelope having a viewing window, a luminescent viewing screen supported on the inner surface of the viewing window, a shadow mask closely spaced from the viewing screen and an electron-gun mount assembly for generating one or more electron beams for selectively exciting the screen to luminescene. The shadow mask, which is a thin metal membrane having precisely-sized and spaced apertures therethrough, is used as a photographic master for making the screen, and then is used, during the operation of the tube, to aid in color selection on the screen by shadowing the electron beams. In both of these functions, it is important that the apertures therein follow closely in sizes and spacings with the mask specifications.

The mask is made by etching apertures into a strip of cold-rolled steel or other etchable metallic material thereby producing a flat mask, removing the flat mask from the strip, and then forming the flat mask to a desired shape. The strip is ordinarily about 0.15 mm (6 mils) thick, but may be as thin as 0.10 mm (4 mils) and as thick as 0.20 mm (8 mils). The apertures may be round or slit-shaped and may range in diameter or width from about 0.25 mm (10 mils) to less than the thickness of the strip. In order to etch such small-sized apertures, both major surfaces of the strip carry stencils thereon of etch-resistant material having openings therein that are registered with one another. The stencil openings in the obverse side or "O-side" of the strip are smaller and close to the sizes desired in the etched apertures. The stencil openings in the reverse side or "R-side" of the strip are larger than the sizes of the desired etched apertures. During the etching step, most of the etching occurs on the R-side, thereby permitting the etched apertures to be tapered and the cross sections of the apertures at their narrowest dimensions to be determined by the sizes of the stencil openings on the O-side.

With thin strips, further control during the etching step can be achieved by shielding the O-side from etchant during a portion of the etching step. U.S. Pat. No. 3,679,500 to N. Kubo et al. issued July 25, 1972 suggests briefly etching both sides of the strip, then coating the O-side with an etch-resistant material and then etching through only from the R-side. U.S. Pat. No. 2,750,524 to F. G. Braham issued June 12, 1956 suggests temporarily coating the O-side with etch-resistant material, then etching partially through from the R-side, then stripping off the temporary coating and then etching completely through from both sides. U.S. Pat. Nos. 3,971,682 issued July 27, 1976 and 4,013,498 issued Mar. 22, 1977, both to J. J. Frantzen et al., employ the method disclosed in Braham supra but substitute, for the temporary coating, a plastic sheet that temporarily lies upon the O-side during the initial portion of the etching step and then is removed. U.S. Pat. No. 4,142,437 to H. H. Bond et al. issued Nov. 7, 1978 discloses another variation of the method disclosed in Braham, supra.

The principle of shielding the O-side of the strip during a portion of the etching step can achieve the goal of producing precisely-etched apertures that may be smaller than the thickness of the strip. However, the prior methods for implementing this principle are difficult to work with and are not particularly cost effective. The novel method applies the same principle as is disclosed in Braham, but in a different way that is easier and less costly to implement than the prior methods mentioned above.

SUMMARY OF THE INVENTION

In the novel method, as in prior methods, a continuous etchable metallic strip having etch-resistant stencils on both major surfaces thereof is moved through an etching chamber where liquid etchant is sprayed toward both major surfaces. Unlike prior methods, one of the major surfaces is shielded from exposure to etchant during the initial portion of the etching step by a stationary wall opposite and spaced from the shielded surface, and by continuous side seals between the stationary wall and the edge portions of the moving strip. The stationary wall, which is preferably solid, and the moving strip define a shielding chamber for the strip. The shielding chamber may have an end seal also, may carry a higher gas pressure than the etching chamber, and its position may be adjustable in the direction of, or opposite to the direction of, movement of the strip.

DETAILED DESCRIPTION OF THE PREFERRED EMBODIMENTS

Figure 1:
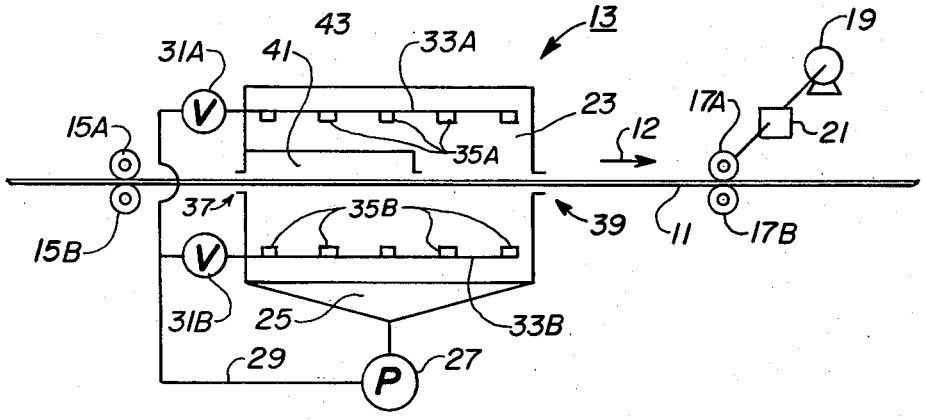
FIG. 1 is a schematic representation of a portion of an apparatus for practicing the novel method with a horizontally-oriented strip.

FIG. 1 shows schematically a horizontally-oriented metal strip 11 to be etched while moving through an etching station 13 from left to right as shown in the figure as indicated by the arrow 12. The strip 11, which is of low-carbon, cold-rolled steel about 21.375 inches wide and about 0.15 mm (6 mils) thick, moves at about 305 to 457 mm (12 to 18 inches) per minute through the station. The strip 11 carries etch-resistant stencils thereon, substantially as described in U.S. Pat. No.

4,061,529 to A. Goldman et al. issued December 6, 1977 and is supported between a first pair of rollers 15A and 15B and a second pair of rollers 17A and 17B on the entrance and exit sides respectively of the etching chamber 13. The strip 11 is moved by the rotation of the upper roller 17A of the second pair, which is mechanically driven by a motor 19 through a variable-speed reducer 21.

The etching station 13 comprises a closed etching chamber 23 about 90 inches long, the bottom of which drains to a sump 25 below the strip 11. Liquid etchant in the sump is pumped by a pump 27 through piping 29 through top and bottom valves 31A and 31B through top and bottom headers (not shown) into spray tubes 33A and 33B respectively and sprayed out of upper and lower nozzles 35A and 35B respectively in the spray tubes toward the moving strip 11. The etchant is sprayed with a pressure in the range of 10 to 40 pounds per square inch sufficient to impinge on the strip if the strip is not shielded. The sprayed etchant then drains to the sump 25.

The etching chamber 23 has an entrance port 37 and an exit port 39. A shielding chamber 41 about 60 inches long, defined by the upper major surface of the strip 11 and a solid wall 43 of clear acrylic plastic about 11.8 mm (0.25 inch) thick, extends from entrance port 39 over half the length of the etching chamber 23. The wall 43 may be of opaque fiberglass-reinforced vinyl ester instead of clear acrylic plastic. The shielding chamber 41 shields the upper major surface of the strip 11 (which is the O-side of the strip in this embodiment) from liquid etchant during the initial portion of the etching step while permitting liquid etchant to impinge upon the lower major surface (which is the R-side of the strip in this embodiment).

Figure 2:
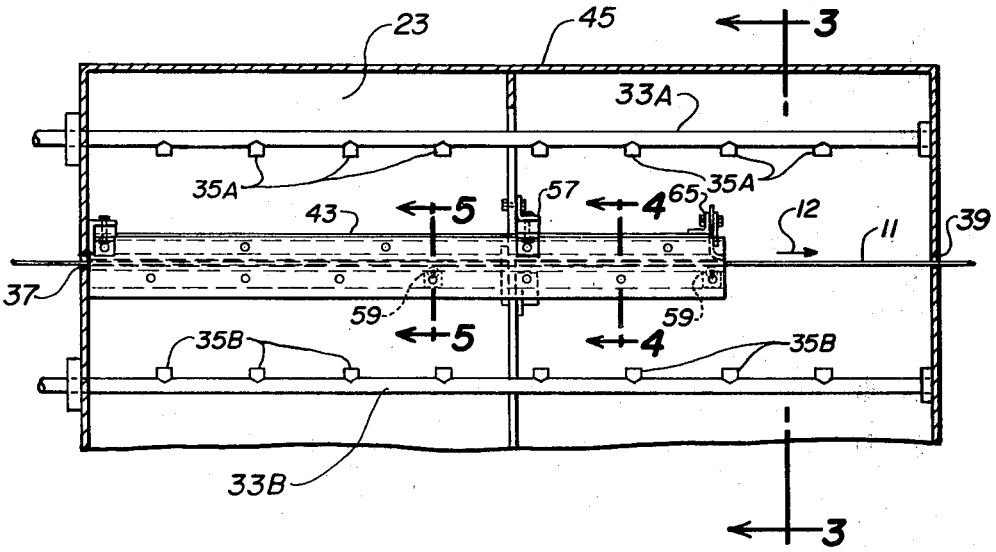
FIG. 2 is a partially-broken-away, sectional, elevational view of a preferred etching chamber for practicing the novel method with a horizontally-oriented strip.
Figure 3:
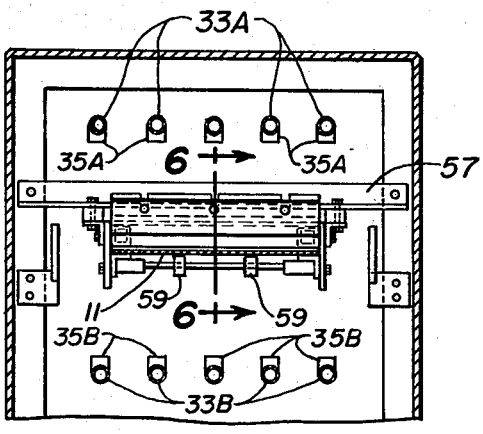
FIG. 3 is a partially-broken-away sectional end view of the etching chamber shown in FIG. 2 viewed from section line 3—3 of FIG. 2.

The etching chamber 23 shown in more detail in FIGS. 2 and 3 comprises an acid-resistant box 45 having an entrance port 37 and an exit port 39 through which a continuous metal strip 11 enters and exits. There are five top spray tubes 33A and five bottom spray tubes 33B which can rotationally oscillate back and forth in a narrow arc around their respective axes so that the nozzles 35A and 35B sweep the sprays of etchant therefrom back and forth across the strip 11. A wall 43 of an acrylic plastic is mounted above the strip 11 so that the spray of etchant from upper nozzles 35A is intercepted over more than half of the path of the strip 11 through the etching chamber 23.

Figure 4:
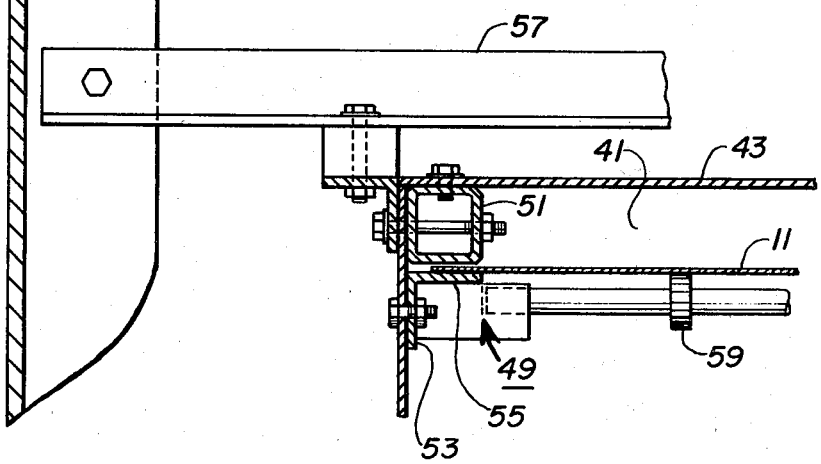
FIG. 4 is a partially-broken-away sectional view along section line 4—4 of FIG. 2 showing a side seal in more detail.
Figure 5:
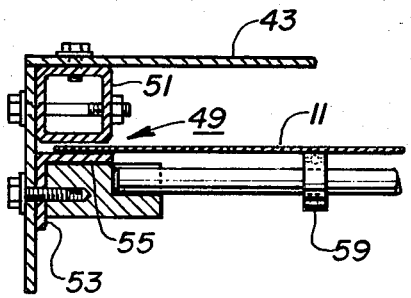
FIG. 5 is a partially-broken-away sectional view along section line 5—5 of FIG. 2 showing the side seal at another location.

Each edge portion of the strip 11 rides in side seals 49. Each side seal 49, shown in detail in FIGS. 4 and 5, comprises a box-shaped upper member 51 above the edge portion of the strip 11 and an angle-shaped lower member 53 having one leg 55 horizontally positioned below the edge portion of the strip 11 and opposite the box-shaped member 51. The space between the upper member 51 and the strip 11, plus the space between the lower member 53 and the strip 11, defines a U-shaped channel which blocks the passage of etchant spray from the lower nozzles 35B into the shielding chamber 41. FIG. 4 shows how the seals 49 are supported from a brace 57, which is supported from the frame of the box 45. FIG. 5 shows a roller support 59 that is supported from the seal structure. The roller support 59 helps to prevent the strip 11 from sagging during its passage through the etching chamber 23.

Figure 6:
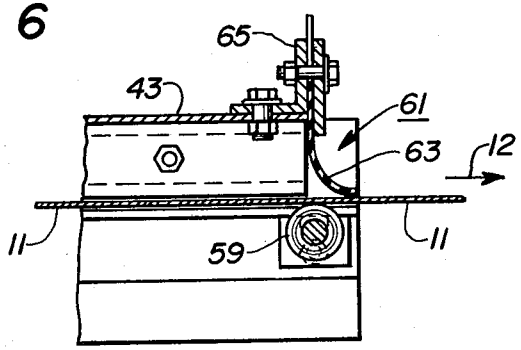
FIG. 6 is a partially-broken-away sectional view along section line 6—6 of FIG. 3 showing an end seal in more detail.

Although it is not necessary, it is desirable to provide a seal at the exit end of the shielding chamber 41. A preferred end seal 61, shown in FIG. 6, comprises a flexible sheet 63 attached at one edge to an angle brace 65, which is attached to the shielding wall 43. The opposite edge of the sheet 63 rides on the upper surface of the strip 11, producing a flexible baffle which blocks etchant from entering the shielding chamber 41.

Figure 7:
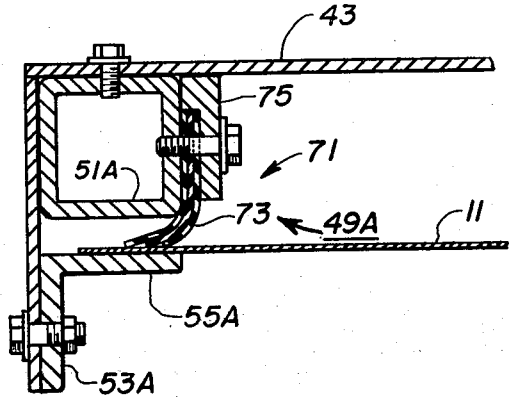
FIG. 7 is a partially-broken-away sectional view of a side seal that can be used in place of the side seal shown in FIGS. 4 and 5.

FIG. 7 shows an alternative side seal 71, which is similar in construction to the side seal shown in FIG. 4, except in two respects. The upper member and the lower member 51A and 55A are spaced further apart. A plurality of flexible sheets 73 placed one upon the other is clamped to the side of the upper member with a clamp 75. The flexible sheets 73 are of such lengths that they ride on the upper surface of the edge portions of the strip 11 and are flexed as shown in FIG. 7, thereby pressing the strip 11 against the lower member 55A. This type of side seal is much tighter than the side seal shown in FIG. 4 and requires more pull on the strip 11 to overcome the frictional drag from the contacting surfaces.

Figure 8:
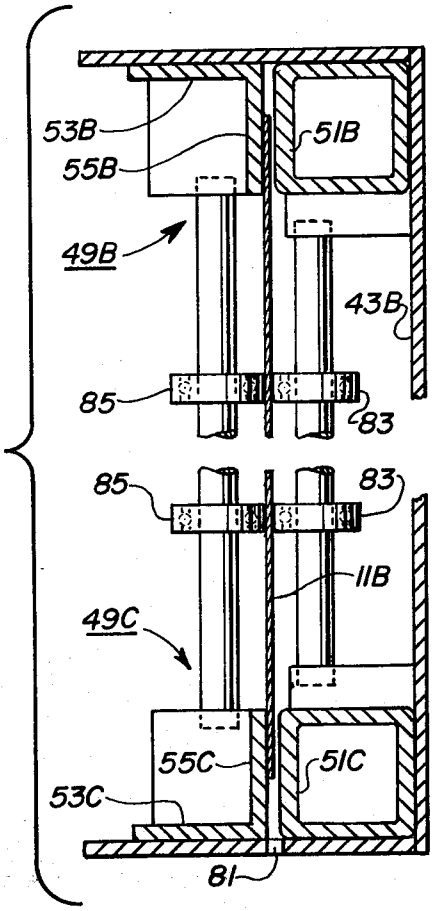
FIG. 8 is a partially-broken-away sectional view of a side seal that can be used in a chamber for etching a vertically-oriented metal strip by the novel method.

FIG. 8 shows a seal arrangement for practicing the novel method on a vertically-oriented metal strip 11B. The structure of the upper and lower side seals 49B and 49C respectively is similar to that shown in FIG. 5 except that the side seals are vertically disposed with respect to one another, and the lower seal 49C is provided with drain ports 81 permitting etchant to drain from the seal back to the sump. The structure of FIG. 8 also includes roller supports 83 and 85 that help to prevent the vertically-oriented strip 11B from buckling.

GENERAL CONSIDERATIONS

Conventional etching of shadow masks takes place from both sides of the strip simultaneously. Because this etching takes place laterally as well as perpendicular to the surface being etched, the width of the opening increases 50% to 80% as rapidly as the depth. There is also a practical limitation to the minimum size of the artwork which is used to produce photographically the etch-resistant stencils (resist coating) on the strip material being etched. These two factors, combined with a need to clean out the etched apertures after the etching from both sides has joined, limit the minimum, clearly-defined aperture dimension to about equal to the thickness of the material being etched.

Our approach to solving this problem is to provide a stationary shielding chamber within the etching chamber. The purpose of the shielding chamber is to delay the etching of the small-hole side (also called the obverse or the O-side) of the strip until the large-hole side (also called the reverse or the R side) is etched to a predetermined depth. At this point, the strip material moves out of the shielding chamber, and etching is allowed to take place simultaneously from both sides to produce the desired apertures in the strip. The unetched strip of material moves continuously into the etching chamber at one end, while the completely-etched strip moves out the other. The shielding chamber at the entrance end of the etching chamber prevents the etching of the O-side until the R-side is etched to a desired depth, leaving a desired thickness of etchable material to be etched from both sides. The narrowest portions of the etched apertures are very near the O-side of the strip.

The strip may be composed of any etchable metallic material. The strip is preferably composed of a metal or a metal alloy, such as copper or a copper alloy or iron or an iron alloy. For making shadow masks for television picture tubes, the strip material preferably consists of a continuous strip of low-carbon, cold-rolled steel of any desired width and from about 0.10 to 0.175 mm (0.004 to 0.007 inch) thick. The strip may be moved through the etching chamber at any desired speed. Speeds in the range of 305 to 2125 mm (12 to 85 inches) per minute are practical, with factory mass-production speeds at the upper end of this range.

The protective shielding chamber is provided with side seals which prevent the etchant from making any contact with the protected or shielded side of the material being etched. Several designs were proposed for accomplishing this sealing. The simplest ones were selected for the initial evaluation and are shown in FIGS. 4 and 5.

An additional feature is the ability to adjust the ratio of the etched time to unetched time for the shielded side of the strip. This may be accomplished by adjusting the portion of the shielding chamber that is within the etching chamber. In one form, the shielding chamber is movable so that it can be positioned to be entirely within the etching chamber as shown in FIG. 2, or can be adjusted to another position so that part of the etching chamber extends out of the entrance to the etching chamber by a predetermined amount.

The novel method uses a shielding chamber that is stationary, instead of an etch-resistant sheet or coating which moves with the strip being etched as in prior methods. The prior methods are more expensive and more difficult to operate than is the novel method.

Because holes in the O-side and R-side stencils are registered with each other, initially etching only from the R-side effectively reduces the thickness of the strip material so that only a minimum of O-side etching is required before the material is completely etched through. This has at least the following advantages:

1. A minimum of lateral etching occurs before the etching is complete, so that the holes in the O-side stencil can be made larger relative to the narrowest portion of the etched apertures in the strip.

2. The amount of clean out required after the etched openings from the O-side and R-side are joined is minimized.

3. The etched O-side openings in the strip very closely approximate the holes in the O-side stencil with the narrowest portions of the etched apertures very near the O-side of the strip.

As a result of these factors, the minimum obtainable size of etched openings can be reduced to less than the thickness of the strip. In addition, the definition of the openings is much more precise than that obtained when etching is allowed to take place simultaneously from both sides.

These statements are evidenced by the data in the TABLE taken from several runs of cold-rolled steel strip according to the preferred embodiment described above. "Aperture shape" is either a hexagonal array of round apertures or an array of parallel slits. "Etching process" is either the prior method with no shielding chamber present or the novel method with a shielding chamber present. The strip thickness, the O-side stencil opening and the corresponding minimum dimension of the etched aperture are given in mils. Also given in mils is the "delta", which is the amount of lateral etching that occurred as measured by the difference between the minimum dimensions of the O-side stencil openings and the etched apertures. The reduced amount of lateral etching is shown by the lower values of delta.

TABLE

| | Etching Process | Strip Thickness | Aperture Shape | Minimum Etched Opening | O-Side Stencil Opening | Delta |
|---|---|---|---|---|---|---|
| 1 | Prior | 5.0 | Round | 5.4 | 2.9 | 2.5 |
| 2 | Prior | 4.0 | Round | 5.4 | 3.4 | 2.0 |
| 3 | Novel | 6.0 | Round | 4.1 | 3.4 | 0.7 |
| 4 | Novel | 5.0 | Round | 4.3 | 3.4 | 0.9 |
| 5 | Prior | 6.0 | Slit | 6.6 | 3.6 | 3.0 |
| 6 | Prior | 4.0 | Slit | 4.7 | 1.9 | 2.8 |
| 7 | Novel | 6.0 | Slit | 5.1 | 3.6 | 1.5 |
| 8 | Novel | 6.0 | Slit | 5.1 | 3.4 | 1.7 |

What is claimed is:

1. In a method of etching a continuous etchable metallic strip from both major surfaces thereof to produce a multiplicity of apertures therethrough, said strip having a first acid-resistant stencil on one major surface thereof and a second acid-resistant stencil on the other major surface thereof, said first and second stencils having openings therein that are registered one with the other, said method including the steps of:

(a) moving said strip through an etching chamber, (b) spraying liquid etchant in said chamber toward both of said major surfaces and (c) shielding one of said major surfaces from exposure to said sprayed liquid etchant during the initial portion of said spraying step, the improvement wherein said shielding is achieved by interposing a stationary wall opposite and spaced from said shielded surface and providing continuous side seals between said stationary wall and the edge portions of said moving strip, said strip and said wall defining a shielding chamber for said strip.

2. The method defined in claim 1 wherein said wall is rigid and is constituted of a solid material.

3. The method defined in claim 1 wherein each of said side seals comprises a U-shaped groove around and closely spaced from the edge portion of both major surfaces of said strip, the walls of said groove and said edge portions of said strip defining a relatively long, narrow nonlinear path between said shielding chamber and said etching chamber.

4. The method defined in claim 1 including an end seal across said strip between said shielding chamber and said etching chamber at the exit end of said shielding chamber.

5. The method defined in claim 4 wherein the gas pressure is higher in said shielding chamber than in said etching chamber.

6. The method defined in claim 1 wherein said major surfaces are oriented in a vertical direction.

7. The method defined in claim 1 wherein said major surfaces are oriented in a horizontal direction.

8. The method defined in claim 7 wherein said one major surface faces up, and said other major surface faces down, and said wall is spaced above said one major surface.

9. The method defined in claim 8 wherein the openings in said first stencil are smaller than the thickness of said strip, and the openings in said second stencil are larger than the thickness of said strip.

10. The method defined in claim 1 wherein the positions of said stationary wall and said side seals can be adjusted in the direction, and opposite to the direction, of movement of said strip.

* * * * *